US010564590B2

(12) United States Patent
Hirota

(10) Patent No.: US 10,564,590 B2
(45) Date of Patent: Feb. 18, 2020

(54) IMAGE FORMING APPARATUS

(71) Applicant: CANON KABUSHIKI KAISHA, Tokyo (JP)

(72) Inventor: Shingo Hirota, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/223,378

(22) Filed: Dec. 18, 2018

(65) Prior Publication Data

US 2019/0196389 A1 Jun. 27, 2019

(30) Foreign Application Priority Data

Dec. 27, 2017 (JP) ..... 2017-252605

(51) Int. Cl.
*G03G 21/00* (2006.01)

(52) U.S. Cl.
CPC ..... *G03G 21/0017* (2013.01); *G03G 21/0011* (2013.01); *G03G 21/0029* (2013.01)

(58) Field of Classification Search
CPC ..... G03G 21/0011; G03G 21/0017; G03G 21/0029; G03G 21/0035; G03G 21/0076; G03G 21/0088
See application file for complete search history.

(56) References Cited

U.S. PATENT DOCUMENTS

| | | | | |
|---|---|---|---|---|
| 9,817,358 | B2 | 11/2017 | Abe et al. | |
| 2004/0240915 | A1* | 12/2004 | Nakayama | G03G 21/0017 399/345 |
| 2016/0004207 | A1* | 1/2016 | Sakaguchi | G03G 21/0017 399/350 |
| 2017/0052500 | A1* | 2/2017 | Fukuda | G03G 21/0035 |

FOREIGN PATENT DOCUMENTS

| | | | |
|---|---|---|---|
| JP | H02-129647 | A | 5/1990 |
| JP | 2007-033856 | A | 2/2007 |
| JP | 2008-257011 | A | 10/2008 |
| JP | 2009-014979 | A | 1/2009 |
| JP | 2016-208601 | A | 12/2016 |
| JP | 6094780 | B2 | 3/2017 |

* cited by examiner

*Primary Examiner* — Hoang X Ngo
(74) *Attorney, Agent, or Firm* — Venable LLP

(57) ABSTRACT

A cleaning blade, which is to be brought into contact with a surface of a photosensitive drum, satisfies the following condition. First, the cleaning blade having a free length of 8 mm is brought into contact with an opposed object for measurement having a plurality of measurement recesses each having a partially spherical shape with a depth of 0.7 μm and a radius of 15 μm on a surface so that a linear pressure is 0.196 N/cm and 0.490 N/cm, and a contact angle with respect to the opposed object for measurement is 25°. In this case, a contact width of the cleaning blade in each of the measurement recesses is 4 μm or more and 8 μm or less when the linear pressure is 0.196 N/cm and is 4 μm or more and 13.5 μm or less when the linear pressure is 0.490 N/cm.

10 Claims, 11 Drawing Sheets

IMAGE FORMING APPARATUS

BACKGROUND OF THE INVENTION

Field of the Invention

The present invention relates to an image forming apparatus, such as a copying machine, a printer, a facsimile machine, and a multifunction peripheral having a plurality of functions of those apparatus.

Description of the Related Art

As a configuration of an image forming apparatus, there has hitherto been known the following configuration. A toner image is formed on a surface of a photosensitive drum, and then is transferred onto an intermediate transfer belt and a recording material. After the transfer of the toner image, toner remaining on the photosensitive drum is removed with a cleaning blade.

As the cleaning blade, there have been proposed cleaning blades having configurations disclosed in Japanese Patent No. 6094780 and Japanese Patent Application Laid-Open No. 2016-208601. Further, as the photosensitive drum, for example, according to description in Japanese Patent Application Laid-Open No. H02-129647, there has been proposed a photosensitive drum having a surface subjected to mechanical abrasion.

In this case, when the surface of the photosensitive drum serving as an image bearing member is subjected to mechanical abrasion as described in Japanese Patent Application Laid-Open No. H02-129647, abrasion particles generated by abrasion may remain on the surface of the photosensitive drum in some cases. When the photosensitive drum is driven to rotate in a state in which the abrasion particles remain on the surface, the abrasion particles are accumulated in a nip between the photosensitive drum and the cleaning blade. Then, the accumulated abrasion particles push up the cleaning blade, with the result that a phenomenon in which toner passes through a gap between the cleaning blade and the photosensitive drum is liable to occur.

SUMMARY OF THE INVENTION

An object of the present invention is to provide a configuration in which passing of toner can be suppressed in a state in which the surface of the image bearing member is subjected to mechanical abrasion.

An aspect of the present invention is to provide an image forming apparatus comprising:

an image bearing member configured to rotate while bearing a toner image; and a cleaning blade, which is to be brought into contact with a surface of the image bearing member, and is configured to clean the image bearing member, wherein the image bearing member has a plurality of recesses on a surface thereof, the plurality of recesses each having an aperture width of 5 μm or more and 100 μm or less in a rotational direction of the image bearing member, an aperture width of 5 μm or more and 100 μm or less in a width direction crossing the rotational direction of the image bearing member, and a depth of 0.1 μm or more and 3 μm or less, wherein the cleaning blade includes a rubber member, a distal end portion of the cleaning blade, which is to be brought into contact with the image bearing member, having a hardness higher than a hardness of a base end portion, a contact force per unit length in a longitudinal direction of the cleaning blade with respect to the surface of the image bearing member being 0.196 N/cm or more and 0.490 N/cm or less, and wherein, when the cleaning blade is supported so that a free length from a position at which the cleaning blade is supported to a distal end of the cleaning blade is 8 mm, and when the cleaning blade is brought into contact with an opposed object for measurement having a plurality of measurement recesses each having a partially spherical shape with a depth of 0.7 μm and a radius of 15 μm on a surface so that a contact angle with respect to the opposed object for measurement is 25°, a contact width between the cleaning blade and the opposed object for measurement in each of the measurement recesses is 4 μm or more and 8 μm or less when the contact force per unit length in the longitudinal direction of the cleaning blade is 0.196 N/cm, and is 4 μm or more and 13.5 μm or less when the contact force per unit length in the longitudinal direction of the cleaning blade is 0.490 N/cm.

Further features of the present invention will become apparent from the following description of exemplary embodiments with reference to the attached drawings.

BRIEF DESCRIPTION OF THE DRAWINGS

FIG. 10 is a graph for showing a relationship between a contact width and W/a.

DESCRIPTION OF THE EMBODIMENTS

First Embodiment

Figure 1:
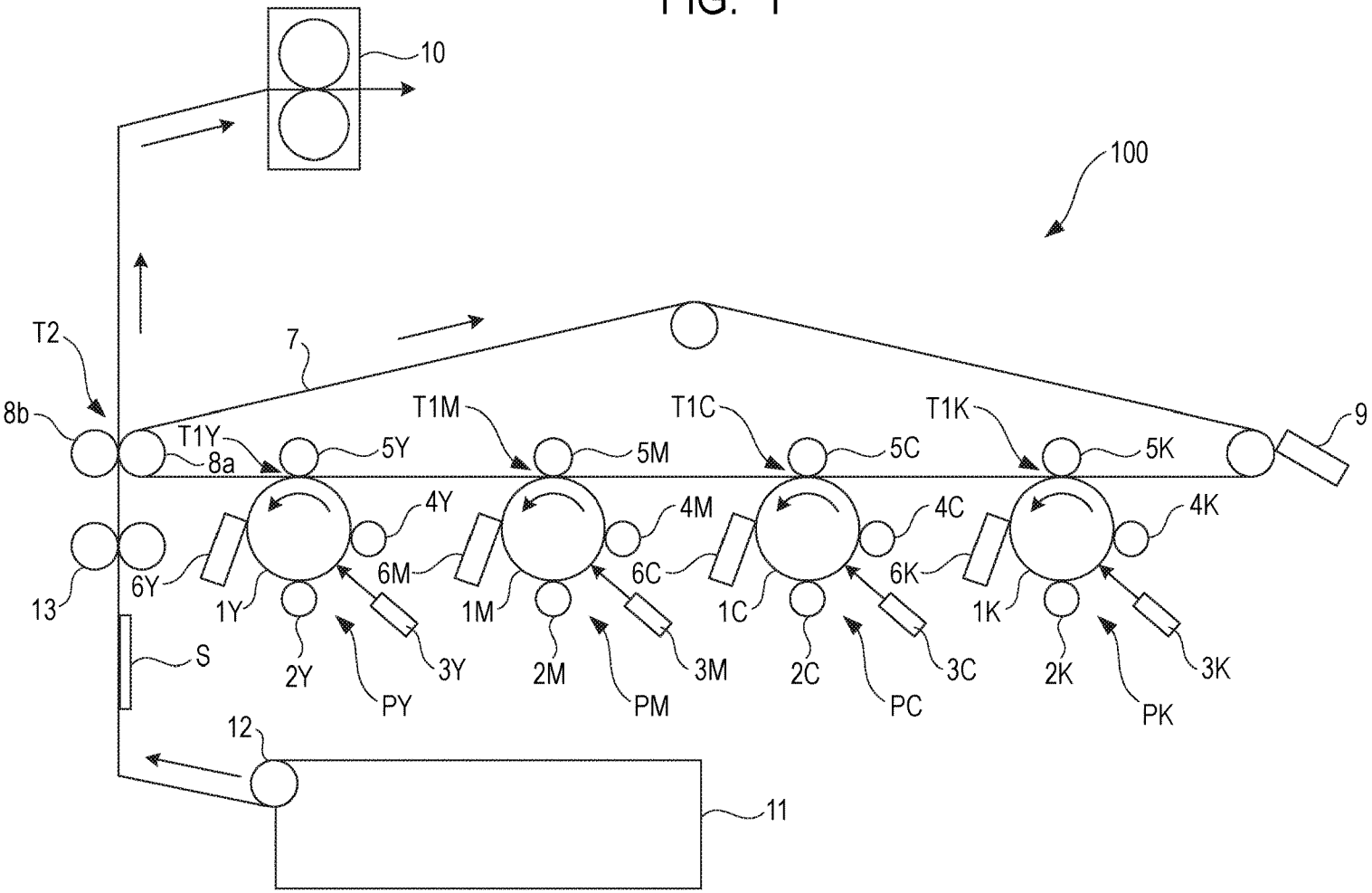
FIG. 1 is a view for illustrating schematic configuration of an image forming apparatus according to a first embodiment of the present invention.

A first embodiment of the present invention is described with reference to FIG. 1 to FIG. 10. First, description is given of an image forming apparatus according to this embodiment with reference to FIG. 1.

[Image Forming Apparatus]

An image forming apparatus 100 is an electrophotographic full-color printer including four image forming portions PY, PM, PC, and PK provided correspondingly to four colors of yellow, magenta, cyan, and black, respectively. In this embodiment, there is employed a tandem type in which the image forming portions PY, PM, PC, and PK are arranged along a rotation direction of an intermediate transfer belt 7 described later. The image forming apparatus 100 is configured to form a toner image (image) on a recording material S in accordance with an image signal from an original reading apparatus (not shown) connected to a main body of the image forming apparatus or from a host apparatus such as a personal computer communicatably connected to the main body of the image forming apparatus. As the recording material, there may be given sheet materials such as paper, a plastic film, and a cloth.

The outline of such image forming process is now described. First, in the image forming portions PY, PM, PC, and PK, toner images of the respective colors are formed on the respective photosensitive drums (electrophotographic photosensitive members) 1Y, 1M, 1C, and 1K, each serving as an image bearing member. The toner images of the respective colors formed in this manner are transferred onto the intermediate transfer belt 7, and are subsequently transferred from the intermediate transfer belt 7 onto the recording material S. The recording material S having the toner images transferred thereon is conveyed to a fixing device 10, and the toner images are fixed onto the recording material. The detailed description is given below.

The four image forming portions PY, PM, PC, and PK of the image forming apparatus 100 have substantially the same structure except that developer colors are different. Therefore, in the following, the image forming portion PY is described as a representative, and description of the configurations of the other image forming portions is omitted.

In the image forming portion PY, there is arranged a cylindrical photosensitive member serving as an image bearing member, that is, the photosensitive drum 1Y. The photosensitive drum 1Y is driven to rotate in a direction indicated by the arrow in FIG. 1. Around the photosensitive drum 1Y, there are arranged a charge roller (charging device) 2Y, a developing device 4Y, a primary transfer roller 5Y, and a drum cleaner 6Y. A laser scanner (exposure device) 3Y is arranged below the photosensitive drum 1Y in FIG. 1.

Further, the intermediate transfer belt 7 is arranged so as to be opposed to the photosensitive drums 1Y, 1M, 1C, and 1K. The intermediate transfer belt 7 is tensioned by a plurality of tension rollers, and is circumferentially moved (rotated) in a direction indicated by the arrow in FIG. 1 through drive of drive rollers among the plurality of tension rollers. A secondary transfer outer roller 8*b* is arranged at a position opposed to a secondary transfer inner roller 8*a* among the plurality of tension rollers across the intermediate transfer belt 7, and thus, a secondary transfer portion T2 configured to transfer the toner image on the intermediate transfer belt 7 onto the recording material S is formed. A fixing device 10 is arranged on a downstream side of the secondary transfer portion T2 in a recording material conveyance direction.

A process of forming an image by the image forming apparatus 100 having the above-mentioned configuration is described. First, when an image forming operation is started, the surface of the photosensitive drum 1Y being rotated is uniformly charged by the charge roller 2Y. Next, the photosensitive drum 1Y is exposed with laser light corresponding to an image signal emitted from the exposure device 3Y. With this, an electrostatic latent image corresponding to the image signal is formed on the photosensitive drum 1Y. The electrostatic latent image on the photosensitive drum 1Y is developed into a visible image with toner stored in the developing device 4Y.

The toner image formed on the photosensitive drum 1Y is primarily transferred onto the intermediate transfer belt 7 at a primary transfer portion T1Y that is formed between the photosensitive drum 1Y and the primary transfer roller 5Y with the intermediate transfer belt 7 interposed therebetween. The toner (untransferred residual toner) remaining on the surface of the photosensitive drum 1Y after the primary transfer is removed by the drum cleaner 6Y.

Such operation is sequentially performed in the respective image forming portions of magenta, cyan, and black, and the toner images of four colors are superposed on one another on the intermediate transfer belt 7. After that, in synchronization with a timing of forming the toner images, the recording material S accommodated in a cassette 11 is picked out by a pickup roller 12 and conveyed to registration rollers 13. Then, skew feed of the recording material S is corrected by the registration rollers 13, and the recording material S is conveyed to the secondary transfer portion T2 by the registration rollers 13 in synchronization with the toner images on the intermediate transfer belt 7. Then, the toner images of four colors on the intermediate transfer belt 7 are secondarily transferred in a collective manner onto the recording material S. Toner that remains on the intermediate transfer belt 7 without being transferred at the secondary transfer portion T2 is removed by a belt cleaner 9.

Next, the recording material S is conveyed to the fixing device 10. Then, the recording material S is heated and pressurized by the fixing device 10 so that the toner on the recording material S is molten and mixed to be fixed as a full-color image onto the recording material S. After that, the recording material S is delivered to an outside of the apparatus. With this, the series of the image forming processes are completed. A single-color image of a desired color or a multi-color image of desired colors may be formed by using only the image forming portion of the desired color.

Next, the configurations of the charge roller 2Y, the exposure device 3Y, the developing device 4Y, and the primary transfer roller 5Y in the image forming portion PY, and the intermediate transfer belt 7 are described in detail. The detailed configurations of the photosensitive drum 1Y, the drum cleaner 6Y, and the belt cleaner 9 are described later.

[Charge Roller]

The charge roller 2Y is a contact-type charging unit configured to uniformly charge the surface of the photosensitive drum 1Y. In this embodiment, the charge roller 2Y has a length of 330 mm in a rotational axis direction and a diameter of 14 mm, and has a configuration in which an electrically conductive rubber layer is formed on an outer periphery of a metal core made of stainless steel. The charge roller 2Y is rotatably held by bearings at both end portions of the metal core, respectively, and is urged toward the photosensitive drum 1Y by a pressure spring to be brought into pressure contact with the surface of the photosensitive drum 1Y with a predetermined pressure force. With this, the charge roller 2Y rotates (peripheral speed of 300 mm/sec) along with rotation of the photosensitive drum 1Y.

The charge roller 2Y is configured to charge the photosensitive drum 1Y through use of a discharge phenomenon that occurs in a minute gap between the charge roller 2Y and the photosensitive drum 1Y. The metal core of the charge roller 2Y is applied with a charging voltage under a predetermined condition by a power supply PS1 (not shown). In this embodiment, the power supply is formed of a DC power source and an AC power source. For example, when a DC voltage to be applied is set to −500 V, and an AC voltage is set to a value that is twice or more of a discharge start voltage in that environment, an image forming region of the rotating photosensitive drum 1Y is uniformly charged to about −500 V. The DC voltage to be applied during image formation is not limited to the above-mentioned value and is appropriately set to an electric potential suitable for preferred image formation in accordance with the environment, the usage condition of the photosensitive drum 1Y and the charge roller 2Y, and the like.

[Exposure Device]

The exposure device 3Y is an information writing unit configured to form an electrostatic latent image on the charged surface of the photosensitive drum 1Y. In this embodiment, the exposure device 3Y is a laser beam scanner using a semiconductor laser. The laser beam scanner is configured to output laser light modulated in accordance with an image signal sent from a host apparatus such as an original reading apparatus to the image forming apparatus 100 side, and subject the uniformly charged surface of the rotating photosensitive drum 1Y to laser scanning exposure. Due to the laser scanning exposure, the absolute value of the electric potential at a portion of the surface of the photosensitive drum 1Y, which is irradiated with the laser light, decreases, and electrostatic latent images corresponding to image information are sequentially formed on the surface of the rotating photosensitive drum 1Y.

[Developing Device]

The developing device 4Y is a developing unit configured to supply toner in accordance with the electrostatic latent image on the photosensitive drum 1Y and subject the electrostatic latent image to reverse development to form a toner image. The developing device 4Y includes a developer container and a developing sleeve. The developer container is configured to accommodate a two-component developer containing non-magnetic toner and a carrier of a magnetic material. The developing sleeve serves as a developer carrier configured to carry and convey the developer accommodated in the developer container. In FIG. 1, this developing sleeve is illustrated as the developing device 4Y. The developing sleeve is arranged so as to be opposed to the photosensitive drum 1Y, and is configured to rotate and convey the developer carried thereon to a developing region opposed to the photosensitive drum 1Y. The length of the developing sleeve in a rotational axis direction is 325 mm.

In this embodiment, the developing sleeve holds a magnetic brush of the two-component developer, and is configured to perform development while bringing the magnetic brush into contact with the photosensitive drum 1Y. Further, as the toner, toner having an average particle diameter of about 6 μm, which is obtained by kneading a pigment into a resin binder mainly containing polyester, followed by pulverization and classification, is used. Further, the toner adhering to the photosensitive drum 1Y has an average charge amount of −30 μC/g.

The developing device 4Y is applied with a predetermined developing voltage from the power supply (not shown). In this embodiment, the predetermined developing voltage is an oscillation voltage in which a DC voltage (Vdc) and an AC voltage (Vac) are superposed on one another. For example, the oscillation voltage is an oscillation voltage in which rectangular-wave AC voltages each having a frequency of 8.0 kHz and a peak-to-peak voltage of 1.8 kV are superposed on one another. The DC voltage is appropriately set so as to be a fog removal potential (difference between the surface potential of the photosensitive drum 1Y and the DC component of the developing voltage) suitable for the potential of the photosensitive drum 1Y in the developing region.

[Primary Transfer Roller]

The primary transfer roller 5Y is a primary transfer unit, which is brought into pressure contact with the photosensitive drum 1Y with a predetermined pressure force in a direction of sandwiching the intermediate transfer belt 7 with the photosensitive drum 1Y, and a pressure contact nip portion thereof corresponds to the primary transfer portion T1Y. The primary transfer roller 5Y is applied with a transfer voltage, which is +600 V in this embodiment, having a positive polarity opposite to a negative polarity being an original charging polarity of toner from the power supply (not shown). With this, the toner images on the photosensitive drums 1Y to 1K are sequentially transferred onto the surface of the intermediate transfer belt 7 electrostatically.

The intermediate transfer belt 7 having the toner images transferred thereto transfers the toner images onto the recording material S, which is fed from the cassette 11 at a predetermined timing, at the secondary transfer portion T2. In this embodiment, the secondary transfer outer roller 8*b* serving as a secondary transfer unit is arranged so as to be brought into contact with the intermediate transfer belt 7, to thereby form the secondary transfer portion T2. The secondary transfer outer roller 8*b* is applied with a transfer voltage of +800 V.

The recording material S having the toner images transferred thereto at the secondary transfer portion T2 is conveyed to the fixing device 10. In this embodiment, the fixing device 10 is a heat roller fixing device including a fixing roller and a pressure roller. The fixing roller includes a heat source therein. The pressure roller is brought into pressure contact with the fixing roller. When the recording material S is conveyed to the pressure contact nip portion between the fixing roller and the pressure roller, the recording material S is heated and pressurized, with the result that the toner images are fixed onto the recording material S.

[Intermediate Transfer Belt]

The intermediate transfer belt 7 serving as an intermediate transfer member is an endless belt. As a material for the intermediate transfer belt 7, a resin-based rubber belt or a rubber belt containing a metallic core, and a belt made of a resin and a rubber are desired. In order to suppress scattering of toner and a void in which a part of the toner image is not transferred, an intermediate transfer belt having an elastic layer may be used. As the intermediate transfer belt 7 in this embodiment, a resin belt containing carbon dispersed in polyimide (PI) and having a volume resistivity controlled to the order of 108 Ωcm is used. The intermediate transfer belt 7 has a thickness of 80 μm and an entire circumference of 900 mm.

[Photosensitive Drum]

Figure 2:
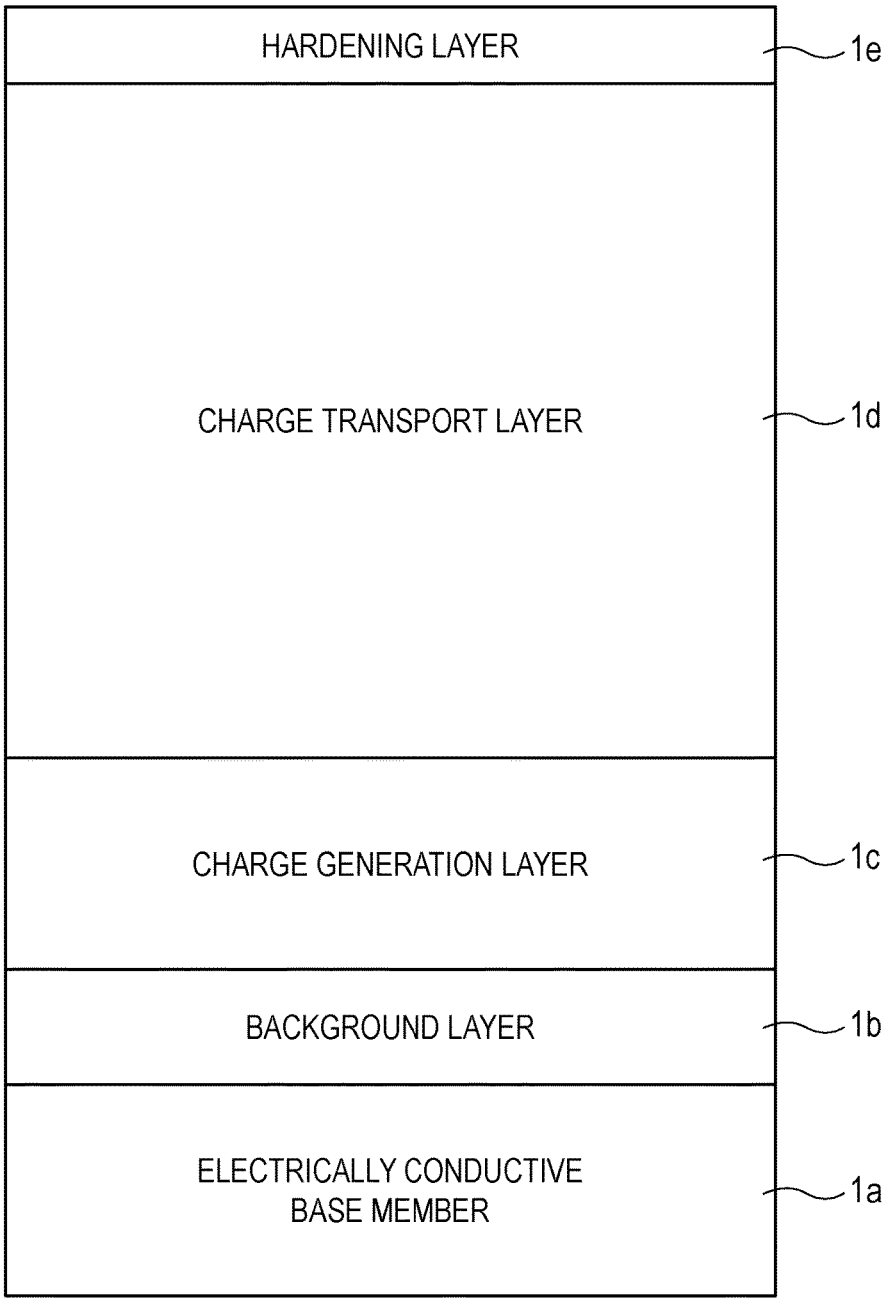
FIG. 2 is a schematic view for illustrating a layer configuration of a photosensitive drum in the first embodiment.

The photosensitive drum 1Y serving as the photosensitive member is described with reference to FIG. 1 and FIG. 2. The same description also applies to the other photosensitive drums 1M, 1C, and 1K. The photosensitive drum 1Y is a rotary drum-type organic electrophotographic photosensitive member having charging characteristics of negative chargeability. As illustrated in FIG. 2, the photosensitive drum 1Y has a layer configuration in which a charge generation layer 1*c* made of an organic material and a charge transport layer (thickness of about 20 μm) 1*d* are recoated successively from a lower portion on a surface of an electrically conductive base member (aluminum cylinder) 1*a* through intermediation of a background layer 1*b*.

In this case, a hardening layer 1*e* using a curable resin as a binder resin is used as a surface layer of the photosensitive drum 1Y. In this embodiment, the hardening layer 1*e* using a curable resin for surface hardening treatment of the photosensitive drum 1Y is used. However, the hardening layer is not limited thereto, and a charge-transporting hardening layer, which is formed by hardening and polymerizing a monomer having a carbon-carbon double bond and a charge-transporting monomer having a carbon-carbon double bond with heat energy or light energy, may be used as the hardening layer. Further, a charge-transporting hardening layer, which is formed by hardening and polymerizing a hole-transporting compound having a chain-polymerizable functional group in the same molecule with electron beam energy, may be used as the hardening layer.

As indicators of the hardening layer 1*e* of the photosensitive drum 1Y, a universal hardness HU and an elastic deformation rate We are measured under an environment having a temperature of 25° C. and a relative humidity of 50%. The universal hardness HU and the elastic deformation rate We are measured through use of Fischerscope H100V (manufactured by Fischer Instruments K.K.) as a micro hardness measurement apparatus which is capable of determining a continuous hardness by continuously applying a load to an indenter and directly reading an indentation depth under the load. As the indenter, a Vickers quadrangular pyramid diamond indenter having a facing angle of 136° is used.

As the load condition, the load is increased to a final load (that is, a maximum load) of 6 mN in stages (273 points in a retention time of 0.1 s at each point). The universal hardness HU is defined by dividing a test load during indentation at the maximum load of 6 mN by the surface area of the Vickers quadrangular pyramid diamond indenter at the test load. The elastic deformation rate We is determined based on an amount (energy) of work which the indenter performs with respect to the hardening layer, that is, a change in energy of the indenter caused by increase and decrease in load with respect to the hardening layer. Thus, the elastic deformation rate We is a result which is obtained by dividing an amount of work Wo of an elastic deformation rate by a total amount of work Wt and presented in percentage.

As the performance required in the photosensitive drum 1Y, there is given improvement of durability against mechanical deterioration. That is, an electrical external force and a mechanical external force are directly applied to the surface of the photosensitive drum 1Y during charging, exposure, development, transfer, and cleaning, and hence the photosensitive drum 1Y is required to have durability against those external forces. Specifically, the photosensitive drum 1Y is required to have durability against the occurrence of scratches and wear on the surface caused by those external forces, that is, scratch resistance and wear resistance. In general, it is considered that the hardness of the hardening layer is higher as the deformation amount thereof against external stress is smaller, and that the durability of the photosensitive drum with respect to mechanical deterioration is improved as the pencil hardness and Vickers hardness thereof are higher.

However, it is not necessarily expected that the durability is improved as the above-mentioned hardness obtained by those measurements is higher. As a result of extensive investigations, the inventors of the present invention have found that, when the values of the universal hardness HU and the elastic deformation rate We fall within a certain range, the mechanical deterioration of the surface layer of the photosensitive drum is less liable to occur. First, a hardness test is performed through use of a Vickers quadrangular pyramid diamond indenter under an environment having a temperature of 25° C. and a relative humidity of 50%. In this case, the durability against the mechanical deterioration is significantly improved through use of the photosensitive drum 1Y in which the universal hardness HU during indentation at the maximum load of 6 mN is 150 N/mm2 or more and 220 N/mm2 or less, and the elastic deformation rate We is 40% or more and 65% or less.

Further, in order to further improve the durability of the photosensitive drum 1Y, it is more preferred that the universal hardness HU be 160 N/mm2 or more and 200 N/mm2 or less. The universal hardness HU and the elastic deformation rate We cannot be considered separately. For example, in a case in which the universal hardness HU is more than 220 N/mm2, the elastic force of the photosensitive drum 1Y becomes insufficient when the elastic deformation rate We is less than 40%. Meanwhile, in a case in which the elastic deformation rate We is more than 65%, the elastic deformation amount becomes small even when the elastic deformation rate We is high. In any case, a large pressure is locally applied consequently to cause a deep scratch in the photosensitive drum 1Y. Thus, it is considered that a photosensitive drum having a high universal hardness HU is not necessarily optimum as a photosensitive drum.

Further, in a case in which the universal hardness HU is less than 150 N/mm2, and the elastic deformation rate We is more than 65%, the plastic deformation amount becomes large even when the elastic deformation rate We is high. Thus, the surface of the photosensitive drum 1Y is rubbed by paper powder and toner sandwiched between the photosensitive drum 1Y and the drum cleaner 6Y and between the photosensitive drum 1Y and the charge roller 2Y. As a result, the surface of the photosensitive drum 1Y is worn, and fine scratches are formed on the surface of the photosensitive drum 1Y.

[Surface Shape of Photosensitive Drum]

Next, the surface shape of the photosensitive drum 1Y of this embodiment is described. The photosensitive drum 1Y has a surface subjected to mechanical abrasion. When the durability of the surface of the photosensitive drum 1Y against mechanical deterioration, such as wear resistance, is improved, a discharge product generated by discharge of the charging device and a wax component contained in toner, which adhere to the surface of the photosensitive drum 1Y, cannot be easily removed with the drum cleaner 6Y. When the discharge product and the wax component are accumulated on the surface of the photosensitive drum 1Y, the friction increases between the photosensitive drum 1Y and a cleaning blade 60 (described later, FIG. 3) of the drum cleaner 6Y, which is configured to remove residual toner on the photosensitive drum 1Y by being brought into contact with the surface of the photosensitive drum 1Y. Such increase in friction causes the behavior of the cleaning blade 60 to be unstable, which results in causing an image defect due to the unstable behavior of the cleaning blade 60 and wear of the cleaning blade 60.

In order to suppress the image defect due to the unstable behavior of the cleaning blade 60 and the wear of the cleaning blade 60, the surface layer of the photosensitive drum is roughened. As a technology of roughening the surface layer, in the first embodiment, mechanical abrasion is performed with respect to the surface of the photosensitive drum 1Y. Specifically, as the photosensitive drum 1Y, a photosensitive drum, which is subjected to mechanical abrasion so as to have a surface roughness Rz (ten-point average roughness) within a range of 0.2 μm or more and 5.0 μm or less, is used. When the photosensitive drum 1Y is combined with the cleaning blade 60 in the first embodiment, it is more preferred that the surface roughness Rz of the photosensitive drum 1Y be 0.2 μm or more and 3.0 μm or less.

When the surface roughness Rz is less than 0.2 μm the contact width between the cleaning blade 60 and the surface of the photosensitive drum 1Y becomes excessively large, and problems such as blade chattering, blade abrasion, and blade chipping occur, with the result that a satisfactory cleaning property may not be obtained. Meanwhile, when the surface roughness Rz is more than 5.0 μm, the cleaning blade 60 cannot sufficiently follow the surface shape of the photosensitive drum 1Y, and the contact width is reduced excessively, with the result that untransferred residual toner cannot be blocked easily, and a cleaning defect such as passing of toner is liable to occur.

The surface roughness of the photosensitive drum 1Y is measured as described below through use of a contact type surface roughness measuring instrument (product name: Surfcorder SE3500 manufactured by Kosaka Laboratory Ltd.). Under the conditions of a detector with a diamond needle of R2 μm and 0.7 mN, a filter of 2CR, a cut-off value of 0.8 mm, a measurement length of 2.5 mm, and a feed speed of 0.1 mm/sec, data on the ten-point average roughness Rz defined by JIS Standard B0601 is processed.

The mechanical abrasion may be performed with respect to an entire region of the surface of the photosensitive drum 1Y or may be performed with respect to a part of the surface. In order to exhibit satisfactory performance, it is desired that the mechanical abrasion be performed at least with respect to a surface portion that is brought into contact with the cleaning blade 60.

In this embodiment, the photosensitive drum 1Y has a length in an axial direction of 340 mm and an outer diameter of 30 mm and is driven to rotate in a direction indicated by the curved arrow at a process speed (circumferential speed) of 200 mm/sec about a center spindle.

[Drum Cleaner]

Figure 5A:
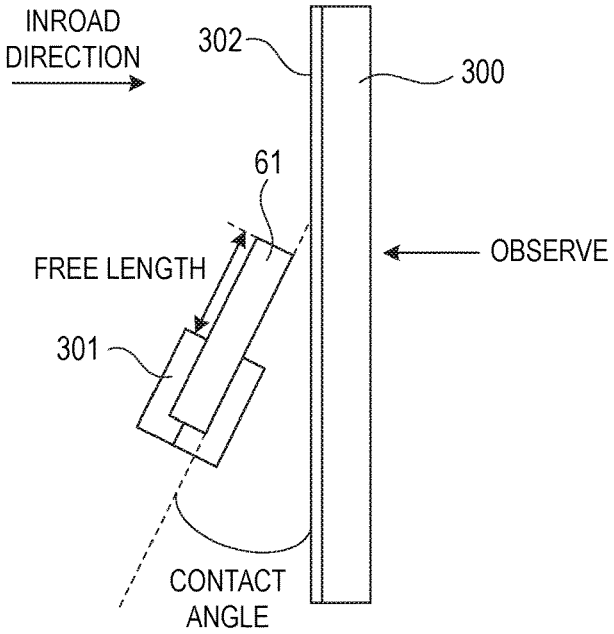
FIG. 5A is a schematic view of a contact width measurement apparatus in a state before a rubber member is brought into contact with a glass plate.
Figure 5B:
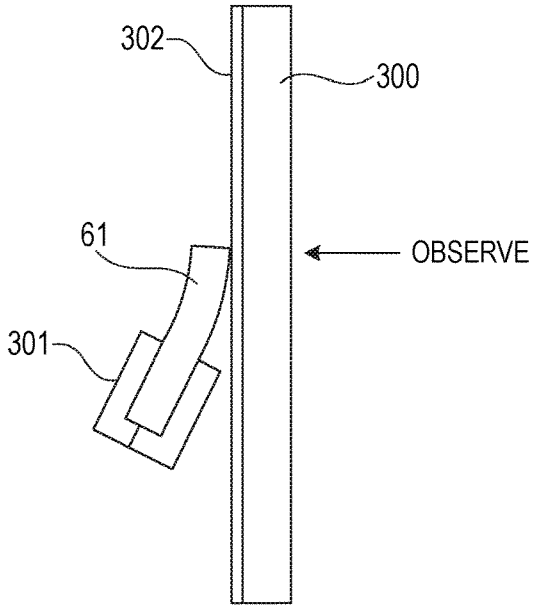
FIG. 5B is a schematic view of the contact width measurement apparatus in a state after the rubber member is brought into contact with the glass plate.

Next, the cleaning blade 60 of the drum cleaner 6Y is described with reference to FIG. 5A and FIG. 5B. The same description also applies to the cleaning blades of other drum cleaners 6M, 6C, and 6K. As described above, the drum cleaner 6Y is configured to remove the untransferred residual toner that slightly remains on the photosensitive drum 1Y from the surface thereof after the toner image transfer to the intermediate transfer belt 7 at the primary transfer portion T1Y. Therefore, the drum cleaner 6Y includes the cleaning blade 60, which is brought into contact with the surface of the photosensitive drum 1Y, and a collection container (not shown) configured to collect toner collected by the cleaning blade 60.

The cleaning blade 60 includes a plate-like rubber member 61 and a sheet metal member 62. The plate-like rubber member 61 has a distal end portion that is brought into contact with the surface of the photosensitive drum 1Y. The sheet metal member 62 serves as a support member configured to support a base end side of the rubber member 61. In this embodiment, the cleaning blade 60 has a configuration in which the rubber member 61 made of a flat plate-shaped urethane rubber is bonded to the sheet metal member 62 with an adhesive. The rubber member 61 has a thickness of 2 mm and is bonded to the sheet metal member 62 with a free length of 8 mm from the position at which the rubber member 61 is supported by the sheet metal member 62 to the distal end.

Further, the cleaning blade 60 has a length of 330 mm in a longitudinal direction (direction parallel to the rotational axis direction of the photosensitive drum 1Y when the cleaning blade 60 is brought into contact with the photosensitive drum 1Y). The cleaning blade 60 is brought into contact with the surface of the photosensitive drum 1Y so that a contact force (linear pressure) per unit length in the longitudinal direction is 0.196 N/cm or more (20 gf/cm or more) and 0.490 N/cm or less (50 gf/cm or less). That is, the cleaning blade 60 is pressed against the photosensitive drum 1Y at a linear pressure within a range of from 20 gf/cm to 50 gf/cm.

When the linear pressure is less than 0.196 N/cm (20 gf/cm), the contact pressure between the cleaning blade 60 and the photosensitive drum 1Y becomes small, and the untransferred residual toner cannot be sufficiently blocked. As a result, a cleaning defect in which the untransferred residual toner passes by the cleaning blade 60 is liable to occur. Meanwhile, when the linear pressure is more than 0.490 N/cm (50 gf/cm), the friction force between the cleaning blade 60 and the photosensitive drum 1Y increases, and problems such as blade chattering, blade wear, and blade chipping occur, with the result that a satisfactory cleaning property is not obtained.

Further, in the cleaning blade 60, W/a obtained by dividing the linear pressure by an inroad amount with respect to the photosensitive drum 1Y is set as described below. Specifically, the cleaning blade 60 is formed so that W/a, which is given at a time when the cleaning blade 60 is brought into contact with the photosensitive drum 1Y so as to form a contact angle of 25° with respect to the photosensitive drum 1Y, satisfies the following condition. That is, W/a is 0.196 N/cm/mm or more (20 gf/cm/mm or more) and 0.441 N/cm/mm or less (45 gf/cm/mm or less). The contact angle and the inroad amount are described later. Further, in this embodiment, the inroad amount is set to, for example, 0.5 mm or more and 2 mm or less. Note that the inroad amount of the cleaning blade 60 with respect to the photosensitive drum 1Y means in this embodiment an imaginary inroad amount but the cleaning blade 60 does not make inroad into the photosensitive drum 1Y.

When W/a is less than 0.196 N/cm/mm (20 gf/cm/mm), the inroad amount for obtaining a required linear pressure increases, and the contact width between the cleaning blade 60 and the photosensitive drum 1Y is extended to decrease a peak pressure, with the result that the toner fusion is liable to occur. Meanwhile, when W/a is more than 0.441 N/cm/mm (45 gf/cm/mm), an abrading amount by which the surface layer of the photosensitive drum 1Y is abraded by the cleaning blade 60 increases, and the wear life of the photosensitive drum 1Y decreases.

[Mechanism of Passing of Toner Caused By Abrasion Particles]

Now, the mechanism of passing of toner caused by abrasion particles is described with reference to FIG. 4. First, there is a technology of reducing a friction force between the photosensitive drum and the cleaning blade by forming irregularities on the surface of the photosensitive drum to reduce the contact width between the photosensitive drum and the cleaning blade. When the irregularities are formed on the surface of the photosensitive drum by mechanical abrasion, abrasion particles generated by mechanical abrasion may remain on the photosensitive drum.

The abrasion particles are removed in a cleaning step after an abrasion step, and the amount of the abrasion particles to be removed increases and decreases due to the runout of the time period of the abrasion step, the contact pressure of an abrasion roller, the time period of the cleaning step, the contact pressure of a cleaning roller, and the like. When the cleaning blade is brought into contact with the photosensitive drum having the abrasion particles adhering thereto and driven, the abrasion particles are collected by the cleaning blade. The abrasion particles each have a diameter of about 1 μm, which is less than the diameter of toner that is usually removed by the cleaning blade, and hence the abrasion particles pass by the cleaning blade without being completely removed by the cleaning blade.

Part of the abrasion particles having passed by the cleaning blade adheres to a region between the photosensitive drum and the cleaning blade to push up the cleaning blade, which causes formation of a gap between the photosensitive drum and the cleaning blade. When an image is formed in a state in which the cleaning blade is pushed up, untransferred residual toner passes through the gap to cause an image defect. The foregoing is the mechanism of passing of toner caused by abrasion particles.

Figure 4:
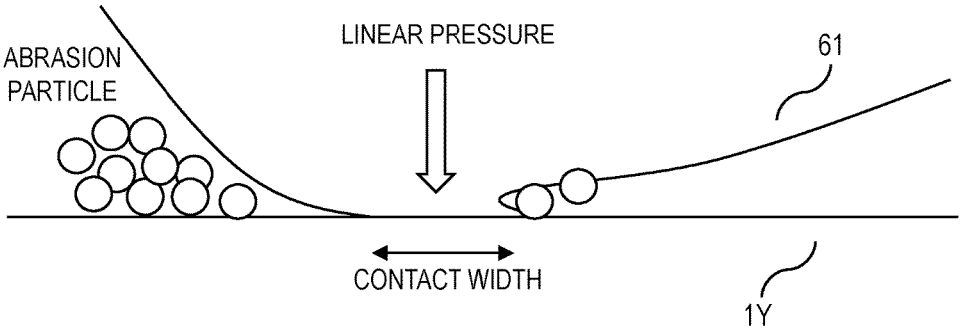
FIG. 4 is a schematic view for illustrating a mechanism of passing of toner caused by abrasion particles.

FIG. 4 is a schematic view for illustrating a cross section of a contact portion between the rubber member 61 of the cleaning blade 60 and the photosensitive drum 1Y. As a method of preventing the passing of toner caused by abrasion particles, there is a method involving improving a cleaning property for removal of abrasion particles so as to prevent the abrasion particles from adhering to the cleaning blade 60. In order to improve the cleaning property for removal of the abrasion particles, it is required to reduce the width (contact width) of the contact surface between the rubber member 61 of the cleaning blade 60 and the photosensitive drum 1Y to increase the peak pressure. With this, abrasion particles each having a particle diameter less than that of toner can also be easily removed by the cleaning blade 60.

In order to reduce the contact width, it is preferred that curling of the rubber member 61, which occurs on the contact surface between the rubber member 61 and the photosensitive drum 1Y, be reduced. The curling of the rubber member 61 occurs through deformation of the rubber member 61 with respect to the friction force that is received from the photosensitive drum 1Y when the rubber member 61 is brought into contact with the photosensitive drum 1Y.

Here, it is conceivable to improve the productivity by shortening the time period of the cleaning step after the abrasion step. In this case, the amount of abrasion particles remaining on the photosensitive drum increases, and the above-mentioned passing of toner caused by abrasion particles is liable to occur.

[Rubber Member]

In view of the foregoing, in the first embodiment, the rubber member 61 of the cleaning blade 60 is formed as described below in order to suppress the occurrence of the passing of toner caused by abrasion particles even in the configuration in which the surface of the photosensitive drum 1Y subjected to mechanical abrasion is cleaned.

Figure 3:
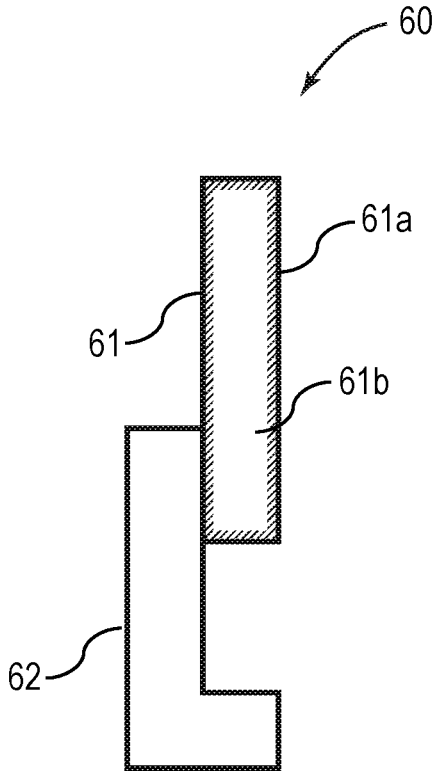
FIG. 3 is a side view for illustrating schematic configuration of a cleaning blade in the first embodiment.

As illustrated in FIG. 3, the rubber member 61 has a surface layer 61*a* having a high hardness on the surface of a base layer 61*b*. The surface layer 61*a* is formed at least on a contact surface between the rubber member 61 and the photosensitive drum 1Y and is present within a range of 1 mm from the surface of the rubber member 61 in a depth direction.

With the hardness of the surface layer 61*a* of the cleaning blade 6 being an indicator, the indentation elastic modulus is measured under an environment having a temperature of 25° C. and a relative humidity of 50% (hardness test). The indentation elastic modulus is measured through use of a micro hardness measurement apparatus Fischerscope HM2000LT (manufactured by Fischer Instruments K.K.) which is capable of determining a continuous hardness by continuously applying a load to an indenter and directly reading an indentation depth under the load. As the indenter, a Vickers quadrangular pyramid diamond indenter having a facing angle of 136° is used. The load condition is as follows. The load is increased to a final load (that is, a maximum load) of 0.98 mN at a load speed of 0.14 mN/s. After that, the final load of 0.98 mN is kept for 5 seconds, and the pressure is reduced (load is removed) at a load speed of 0.14 mN/s.

In the hardness test, the rubber member 61 is cut out from the cleaning blade 60 and fixed to a glass plate having a thickness of 2 mm. Then, the indentation elastic modulus given at a time of removal of a load is measured. In this case, a surface extending in the longitudinal direction (direction parallel to the rotational axis direction of the photosensitive drum 1Y when the rubber member 61 is brought into contact with the photosensitive drum 1Y) of the rubber member 61 and the free length direction (direction directed from the base end of the rubber member 61 to the distal end thereof) is defined as a free length surface (first surface). Further, a surface extending in the longitudinal direction of the rubber member 61 and the thickness direction thereof is defined as a thickness surface (second surface).

Measurement points on the free length surface are set to a point of 30 μm from a contact edge at which the cleaning blade 60 is brought into contact with the surface of the photosensitive drum 1Y and a free length center (4 mm from the contact edge in this embodiment). Meanwhile, measurement points on the thickness surface are set to a point of 30 μm from the contact edge and a thickness center (1 mm from the contact edge in this embodiment).

The rubber member 61 is formed so that a difference, which is larger, among a difference in indentation elastic modulus between the two measurement points on the free length surface and a difference in indentation elastic modulus between the two measurement points on the thickness surface is 0.5 MPa or more and 10.0 MPa or less. Specifically, the entire surface and a range of 100 μm in the depth direction of the rubber member 61 made of a urethane rubber are hardened by isocyanate treatment so as to satisfy the above-mentioned condition, to thereby form the rubber member 61 having the surface layer 61*a*. It is more preferred that the difference in indentation elastic modulus be set to 0.5 MPa or more and 3.0 MPa or less.

However, the rubber member 61 is not limited thereto. The rubber member 61 may have a configuration in which the surface is hardened by treatment through use of isocyanurate or may have a two-layer structure in which two different kinds of materials are laminated. When the difference in indentation elastic modulus is 0.5 MPa or less, the surface layer 61*a* is not sufficiently hardened, and the effect of reducing a contact width is low, with the result that the occurrence of the toner fusion cannot be suppressed sufficiently. Meanwhile, when the difference in indentation elastic modulus is 10.0 MPa or more, the wear resistance of the surface layer 61*a* is degraded, and image defects caused by blade wear and blade chipping occur.

As described above, in order to reduce the curling of the rubber member 61, which causes passing of toner caused by abrasion particles, there are given a method involving increasing the hardness of the rubber member 61 to reduce a deformation amount thereof and a method involving decreasing the friction coefficient of the rubber member 61 to reduce a friction force from the photosensitive drum 1Y. In this embodiment, in a contact width measurement method described later, the rubber member 61 having a contact width of 4 μm or more and 8 μm or less at a linear pressure of 0.196 N/cm (20 gf/cm) and having a contact width of 4 μm or more and 13.5 μm or less at a linear pressure of 0.490 N/cm (50 gf/m) is used.

When the contact width is less than 4 μm, the contact width becomes unstable, and the passing of toner may occur in some cases. When the contact width is more than 13.5 μm, the peak pressure is decreased, and the cleaning property for removal of abrasion particles is degraded, with the result that the passing of toner caused by abrasion particles is liable to occur.

[Contact Width Measurement Method]

Figure 6:
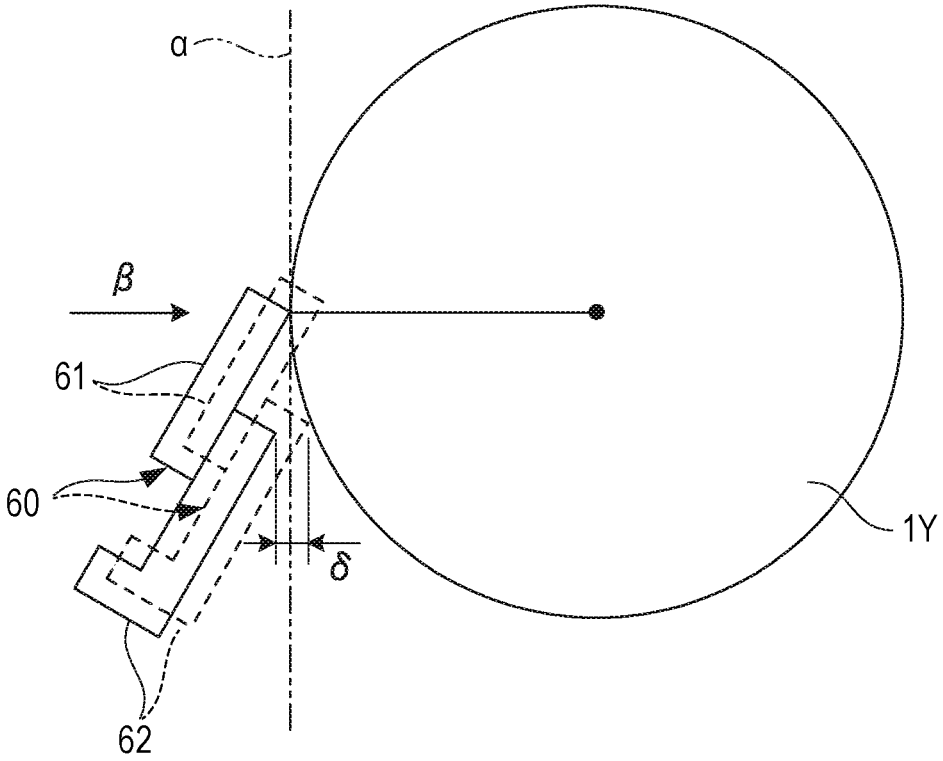
FIG. 6 is an explanatory schematic view for illustrating an inroad amount of the cleaning blade.

Next, a method of measuring a width of the contact surface (contact width) between the cleaning blade 60 and the photosensitive drum 1Y is described with reference to FIG. 5A, FIG. 5B, and FIG. 6. FIG. 5A and FIG. 5B are each a schematic view of a contact width measurement apparatus. The contact width measurement apparatus includes a glass plate 300, a holder 301, and a sheet 302. The glass plate 300 serves as an opposed object for measurement. The holder 301 is configured to hold the rubber member 61. The sheet 302 is bonded to the surface of the glass plate 300.

The contact width is measured by mounting the rubber member 61 of the cleaning blade 60 on the holder 301, bringing the rubber member 61 into contact with the surface of the glass plate 300 having the sheet 302 bonded thereto, and observing the resultant from a rear surface. FIG. 5A is a view for illustrating a state before the rubber member 61 is brought into contact with the glass plate 300, and FIG. 5B is a view for illustrating a state after the rubber member 61 is brought into contact with the glass plate 300.

The rubber member 61 is cut out from the cleaning blade 60 with a length (width) of 3 mm in the longitudinal direction and inserted into the holder 301 to be fixed thereto so as to have a free length of 8 mm. The holder 301 makes inroads with respect to the glass plate 300 at a contact angle of 25° in a direction perpendicular to the glass plate 300 (direction indicated by the arrow in FIG. 7A), and the inroad amount is adjusted so that a linear pressure reaches 20 gf/cm and 50 gf/cm.

Now, the inroad amount of the rubber member 61 is described with reference to FIG. 6. FIG. 6 is a view for illustrating a state in which the cleaning blade 60 is brought into contact with the surface of the photosensitive drum 1Y at a predetermined contact angle (angle formed by a tangent "α" described later and the free length surface of the rubber member 61). First, consideration is given to the state in which the cleaning blade 60 is brought into contact with the surface of the photosensitive drum 1Y as indicated by the solid line so that the cleaning blade 60 is not bent. In this case, as indicated by the broken line, the cleaning blade 60 is pressed against the photosensitive drum 1Y in a direction "β" orthogonal to the tangent "α" of the photosensitive drum 1Y passing through a contact point between the rubber member 61 and the surface of the photosensitive drum 1Y. Then, the rubber member 61 is bent, and the position of the sheet metal member 62 that holds the rubber member 61 moves in the direction "β". A movement amount "δ" of the sheet metal member 62 in the direction "β" is defined as the inroad amount of the rubber member 61.

Figure 7A:
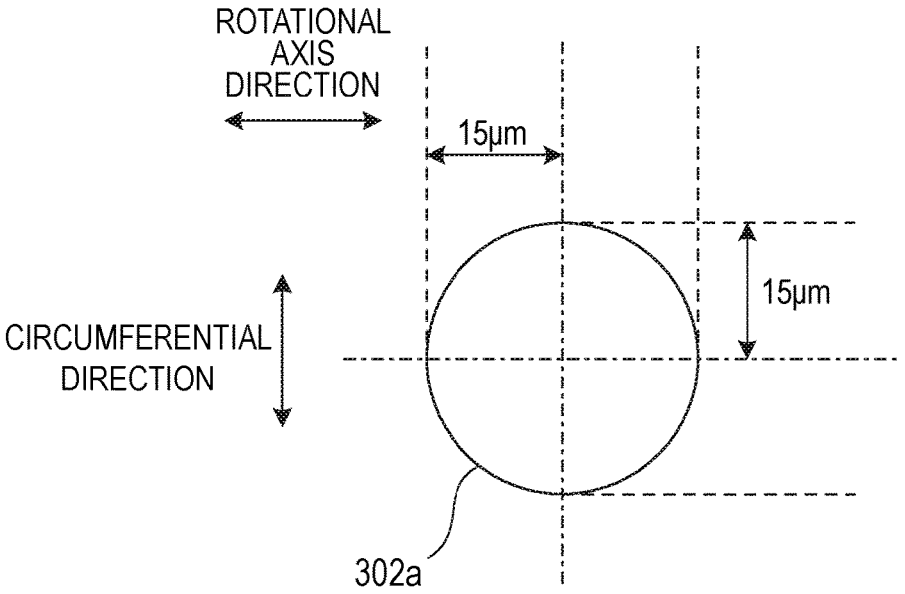
FIG. 7A is a view for illustrating an aperture shape of a measurement recess.
Figure 7B:
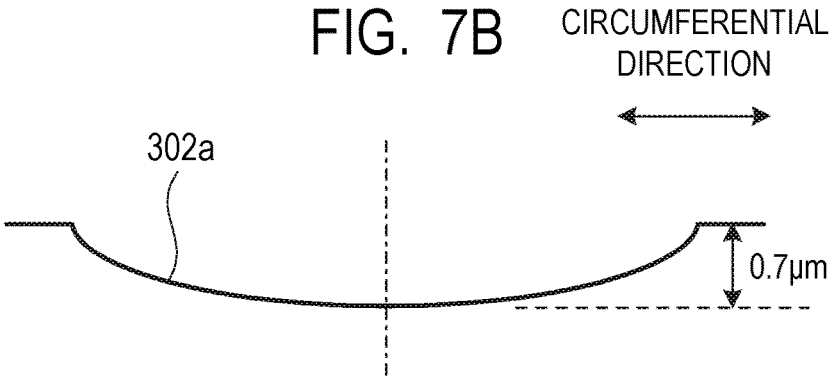
FIG. 7B is a view for illustrating a sectional shape of the measurement recess.

As illustrated in FIG. 7A and FIG. 7B, the sheet 302 on the surface of the glass plate 300, with which the rubber member 61 is brought into contact, has a plurality of recesses 302*a* serving as measurement recesses independently formed on the surface. The plurality of recesses 302*a* each have a partially spherical shape (dome-shape in this embodiment) with a depth of 0.7 μm and a radius of 15 μm. That is, the glass plate 300 has the plurality of recesses 302*a*. FIG. 7A is a view for illustrating an aperture shape of the recess 302*a*, and FIG. 7B is a view for illustrating a sectional shape of the recess 302*a*.

In the contact width measurement method of this embodiment, the rubber member 61 is brought into contact with the surface of the glass plate 300 by the inroad amount described above, and the contact width of the rubber member 61 with respect to the recess 302*a* of the sheet 302 bonded to the surface of the glass plate 300 is measured. The contact portion becomes a shade against the rubber member 61, and hence the contact width can be measured by observing the glass plate 300 from a rear surface side. Note that the contact width in this embodiment means a length in a direction perpendicular to the longitudinal direction (width direction) of the blade, and is directed to a width in a vertical direction in FIG. 8.

Figure 8:
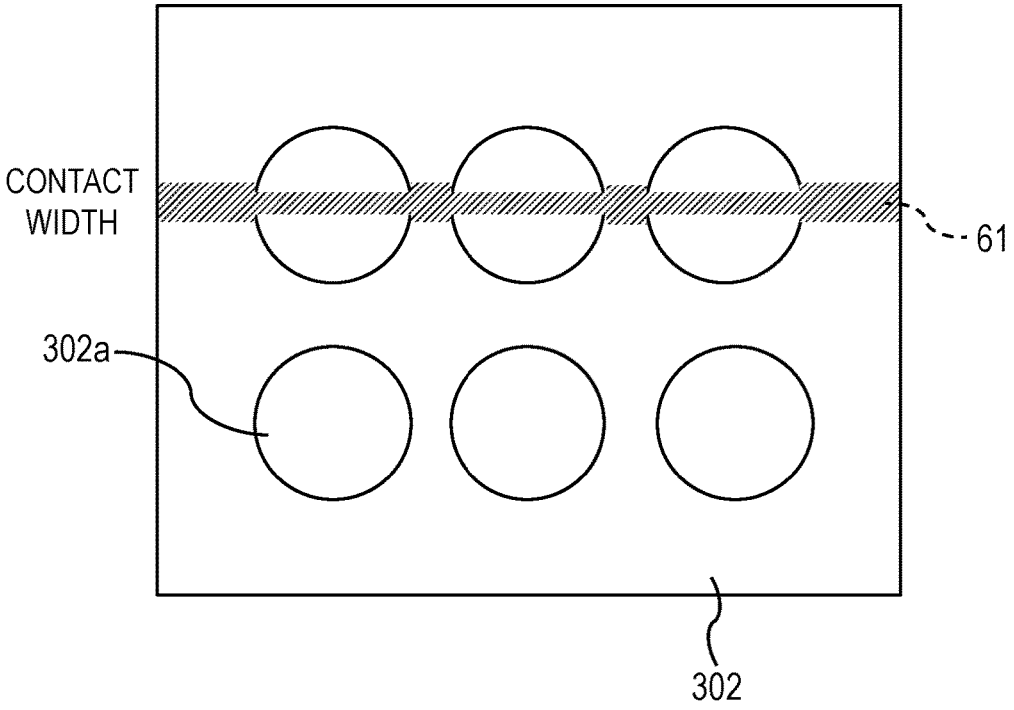
FIG. 8 is an explanatory schematic view of a contact width.

FIG. 8 is a schematic view for illustrating the contact width given at a time when the rubber member 61 is brought into contact with the sheet 302 of the glass plate 300. When the rubber member 61 makes inroads with respect to the glass plate 300, the contact width is formed. In each of the recesses 302*a*, the inroad amount is reduced by a recessed amount as compared to that in a flat portion in which the recesses 302*a* are not formed, and hence the contact width in each of the recesses 302*a* is smaller than that in the flat portion. The recesses 302*a* represent a change in surface of the photosensitive drum 1Y caused by image formation. Thus, when the contact width is measured in the recess 302*a*, the contact width through a change in surface of the photosensitive drum 1Y caused by image formation can be checked. The sheet 302 is made of a material having hardness to some degree so as not to be substantially deformed with respect to the contact with the rubber member 61. Through such measurement, it can be measured whether or not the followability to the recess of the rubber member 61 and the peak pressure required for cleaning the recess are obtained.

[Verification Experiment of Passing of Toner Caused By Abrasion Particles]

Next, a verification experiment for verifying a relationship between the contact width and the passing of toner caused by abrasion particles is described. In Table 1, there are shown results obtained by investigating the physical properties of rubber members used in the verification experiment of passing of toner caused by abrasion particles, the passing of toner caused by abrasion particles, and the wear life of a photosensitive drum. The verification experiment was performed through use of eight kinds of rubber members of rubbers A-1 to D-3 shown in Table 1. Further, the contact width was measured by the above-mentioned method. The contact width in Table 1 is a value given at a time when the linear pressure is 0.490 N/cm (50 gf/cm).

TABLE 1

| Sample | Physical properties of blade: Hardness of base layer (JIS-A) | Physical properties of blade: Difference in indentation hardness (MPa) | Evaluation of physical properties: W/a (gf/cm/mm) | Evaluation of physical properties: Contact width (μm) | Evaluation of characteristics: Passing of toner caused by abrasion particles | Evaluation of characteristics: Wear life of photosensitive drum |
|---|---|---|---|---|---|---|
| A-1 | 71 | 1.5 | 32 | 11.9 | ○ | ○ |
| A-2 | 79 | 1.1 | 41 | 12.5 | ○ | ○ |
| B-1 | 75 | 12.1 | 50 | 2.3 | ○ | x |
| C-1 | 71 | 5.1 | 32 | 14.2 | x | ○ |
| C-2 | 71 | 9.6 | 32 | 13 | ○ | ○ |
| D-1 | 71 | 0 | 32 | 15.8 | x | ○ |
| D-2 | 79 | 0 | 41 | 14.2 | x | ○ |
| D-3 | 85 | 0 | 47 | 13 | ○ | x |

In this case, the rubbers A-1 and A-2 are obtained by hardening the surface layer 61*a* by isocyanate treatment as described with reference to FIG. 3, and the hardness of the base layer 61*b* is given within the above-mentioned treatment range. The rubber B-1 is obtained by hardening the surface layer 61*a* by isocyanate treatment as described with reference to FIG. 3, in which the isocyanate treatment time is extended so that the difference in indentation elastic modulus reaches 10 MPa or more.

Figure 9:
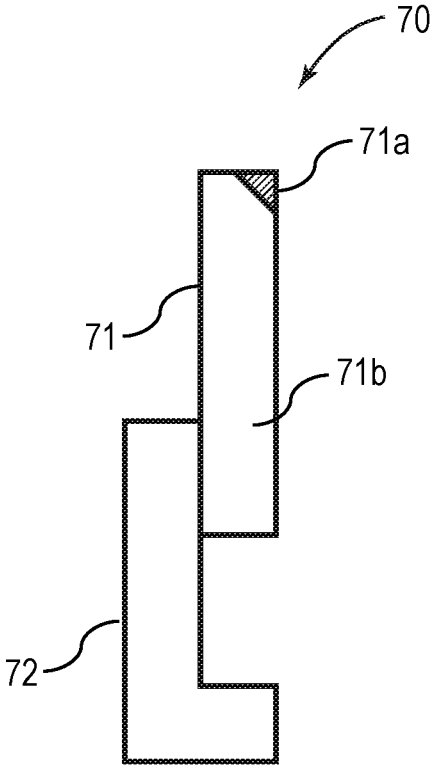
FIG. 9 is a side view for illustrating schematic configuration of a cleaning blade according to a modification example in the first embodiment.

The rubbers C-1 and C-2 are rubber members 71 each having a two-layer structure in which two different kinds of materials are laminated as illustrated in FIG. 9. FIG. 9 is a view for illustrating a cleaning blade 70 having the rubber member 71 formed on a sheet metal member 72. The rubber member 71 includes a surface layer 71*a* laminated on a base layer 71*b*, and the surface layer 71*a* is present at a position of 1 mm in a free length direction and 0.5 mm in a thickness direction from the contact edge between the rubber member 71 and the photosensitive drum 1Y. In the rubbers C-1 and C-2, the hardness of the surface layer 71*a* is given in the configuration illustrated in FIG. 9. Also in the configuration of FIG. 9, the passing of toner caused by abrasion particles can be suppressed in the same manner as in the cleaning blade 60 in the first embodiment. However, it is confirmed that, when the hardness of the surface layer 71*a* is increased, the cleaning blade 60 has disadvantage in wear. The rubber C-2 satisfies the condition in the first embodiment. The rubbers D-1, D-2, and D-3 are each a single-layer rubber member in which the hardness of the single layer is given.

Further, in order to perform the verification experiment of passing of toner caused by abrasion particles in an accelerated manner, the time period of the cleaning step after the mechanical abrasion step of the photosensitive drum 1Y used in the verification experiment was halved as compared to an ordinary time period. Further, in the verification experiment, the photosensitive drum 1Y having a surface roughness Rz of 1.0 μm after the mechanical abrasion step was used.

Now, an indicator of the amount of abrasion particles remaining on the photosensitive drum is described. In the first embodiment, as the indicator, there was used the height from a free length surface of abrasion particles adhering to the free length surface in a contact direction of the cleaning blade with respect to the photosensitive drum after the cleaning blade was brought into contact with the photosensitive drum after the mechanical abrasion step and driven, and the photosensitive drum was driven to rotate 200 times.

In the first embodiment, the photosensitive drum was driven to rotate 200 times. The amount of abrasion particles on the surface of the photosensitive drum subjected to mechanical abrasion is largest before the drive, and abrasion particles is not additionally generated through contact with the cleaning blade. Therefore, when the time period of the cleaning step after the mechanical abrasion step is the ordinary time period, abrasion particles remaining on the photosensitive drum can be actually removed sufficiently by the cleaning blade with a smaller number of rotations. The case in which the time period of the cleaning step after the mechanical abrasion step is set to the ordinary time period and the case in which the time period of the cleaning step is halved as compared to the ordinary time period are described below.

Further, the height of abrasion particles is obtained by removing the cleaning blade from the photosensitive drum after being driven to rotate 200 times, observing the free length surface of the cleaning blade, and actually measuring the height of abrasion particles. In this case, some abrasion particles may be scraped and dropped off when the cleaning blade is removed, and hence the height of the abrasion particles is indicated by the maximum value in the longitudinal direction of the cleaning blade.

First, a cleaning blade using the rubber D-1 was brought into contact with a photosensitive drum manufactured with the time period of the cleaning step after the mechanical abrasion step being set to the ordinary time period, and the height of abrasion particles was measured as described above. In this case, the height of the abrasion particles adhering to the cleaning blade was 1 μm or more and 4 μm or less.

Next, the cleaning blade using the rubber D-1 was brought into contact with a photosensitive drum manufactured with the time period of the cleaning step after the mechanical abrasion step being halved as compared to the related-art time period, and the height of abrasion particles was measured as described above. In this case, the height of the abrasion particles adhering to the cleaning blade was 13 μm or more.

When the cleaning blade using the rubber D-1 was brought into contact with the photosensitive drum that was not subjected to mechanical abrasion, and the height of abrasion particles was measured, no abrasion particle was generated, and hence the height of the abrasion particles adhering to the cleaning blade was substantially 0 μm.

Meanwhile, in the verification experiment of passing of toner caused by abrasion particles, the cleaning blade using the rubber member of each sample was brought into contact with the photosensitive drum. The photosensitive drum was subjected to solid white development of 60 sheets under a low-temperature environment (5° C.) and then to solid development of 5 sheets. It was visually confirmed whether or not toner having passed by the cleaning blade was present on the photosensitive drum in a certain amount (amount that influences an image) or more. The case in which the passing amount was a certain amount or more was defined as "×", and the case in which the passing amount was less than the certain amount and no passing of toner occurred was defined as "○". In the solid white development, development is performed without forming an electrostatic latent image. In the solid development, development is performed by forming an electrostatic latent image so that an image ratio reaches 100%.

When the surface of the photosensitive drum is worn by rubbing with the cleaning blade, the chargeability of the photosensitive drum is decreased, and for example, image defects such as a vertical streak and a horizontal streak occur on an output image. Therefore, in the verification experiment, the wear life of the photosensitive drum was investigated as described below. Specifically, in a low-humidity environment (temperature of 22° C. and relative humidity of 5%), the cleaning blade using the rubber member of each sample was incorporated into an image forming apparatus, and an image was continuously formed on 200,000 sheets at an image ratio of 5%. Then, the presence or absence of image defects was visually checked. For example, when image defects such as a vertical streak and a horizontal streak occurred after the image was formed on less than 200,000 sheets, the result was defined as "×". When the image defects did not occur after the image was formed on 200,000 sheets, the result was defined as "○".

It was found from Table 1 that, when the contact width was 13.5 μm or less, the passing of toner caused by abrasion particles was able to be suppressed. Further, it was found that, when W/a was 0.441 N/cm/mm or less (45 gf/cm/mm or less), the wear life of the photosensitive drum was satisfactory.

Figure 10:
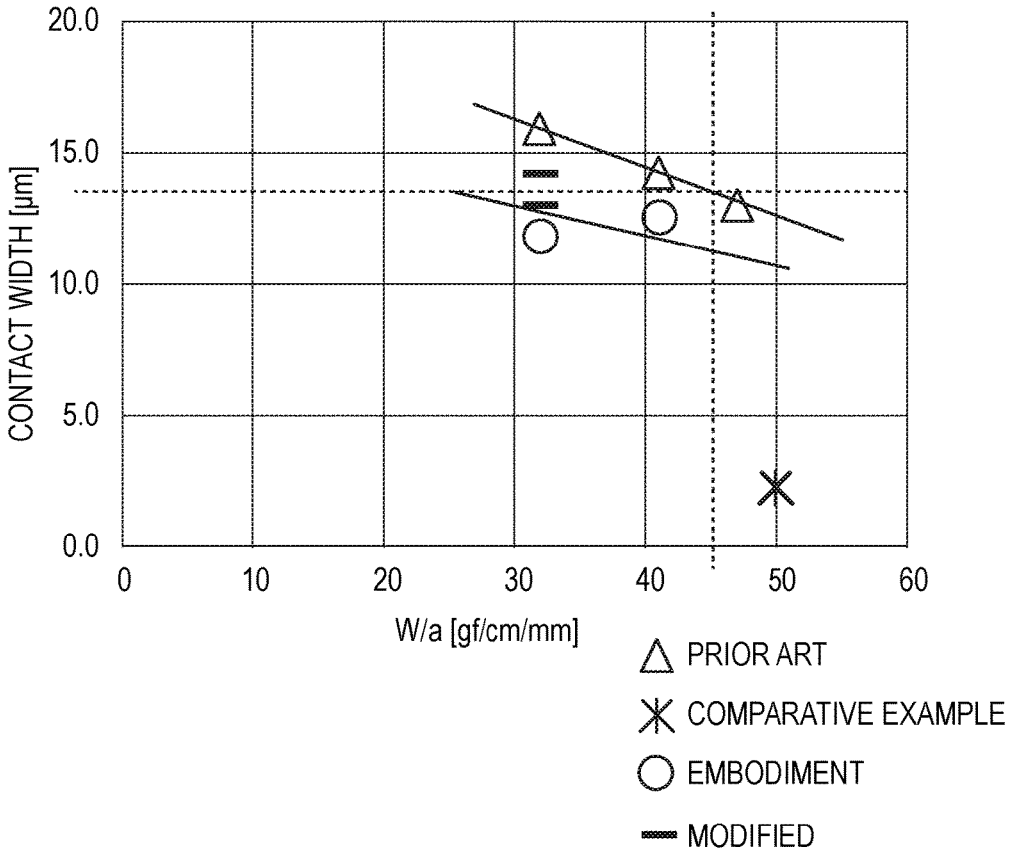

FIG. 10 is a graph for showing a correlation between the W/a and the contact width at a linear pressure of 50 gf/cm in Table 1. In the case of using the rubbers D-1 to D-3 as the rubber member (Prior Art Example), when the hardness of the base layer is increased to increase the W/a, the contact width is reduced. However, when the contact width is reduced to a width at which the passing of toner caused by abrasion particles does not occur, the W/a is increased, and the wear life of the photosensitive drum is shortened.

In the case of using the rubber B-1 as the rubber member (Comparative Example), hardening is performed by extending the treatment time in hardening treatment similar to that in the first embodiment. Therefore, the W/a is increased, and the contact width is reduced to an unstable region.

In the case of using the rubbers C-1 to C-2 as the rubber member (Modified Example), the hardness of the base layer remains unchanged, and hence the W/a is constant. When the hardness of the surface layer is increased, only the contact width can be reduced. Therefore, in the case of using the rubber C-2, both the passing of toner caused by abrasion particles and the reduction in wear life of the photosensitive drum can be suppressed.

Further, in the case of using the rubbers A-1 and A-2 as the rubber member (Embodiment), the contact width can be reduced without increasing the W/a due to hardening treatment performed with respect to the surface layer, and both the passing of toner caused by abrasion particles and the reduction in wear life of the photosensitive drum can be suppressed.

As described above, in the case of the first embodiment, both the passing of toner caused by abrasion particles and the reduction in wear life of the photosensitive drum can be suppressed.

Further, in the case of the first embodiment, even in the photosensitive drum in which the time period of the cleaning step after the mechanical abrasion step is halved, the passing of toner caused by abrasion particles can be suppressed. For example, as an indicator of the amount of abrasion particles remaining on the photosensitive drum, even when the height of abrasion particles becomes more than 4 μm, and further becomes 5 μm or more, 10 μm or more, and 13 μm or more, the passing of toner caused by abrasion particles can be suppressed through use of the configuration in the first embodiment. As a result, the cleaning step after the mechanical abrasion step of the photosensitive drum can be shortened, and the improvement in productivity of the photosensitive drum and the reduction in cost can be achieved.

Second Embodiment

Figure 11:
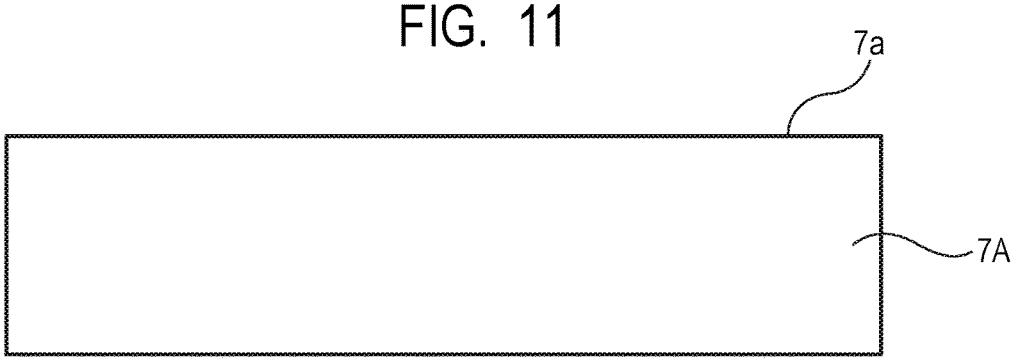
FIG. 11 is a sectional view for illustrating a part of an intermediate transfer belt in a second embodiment of the present invention.

A second embodiment of the present invention is described with reference to FIG. 11. In the first embodiment, the case in which the present invention is applied to the cleaning blade 60 of the drum cleaner 6Y configured to clean the surface of the photosensitive drum 1Y subjected to mechanical abrasion serving as an image bearing member is described. As a cleaning blade of the belt cleaner 9 (see FIG. 1) configured to clean a surface 7*a* of an intermediate transfer belt 7A serving as an image bearing member, the cleaning blade 60 (see FIG. 3) may be used. Therefore, in the second embodiment, untransferred residual toner remaining on the intermediate transfer belt 7A is removed through use of the cleaning blade 60 similar to that in the first embodiment.

The intermediate transfer belt 7A serving as an intermediate transfer member is an endless belt, and is a single-layer belt made of a resin. As the intermediate transfer belt 7A in the second embodiment, a resin belt containing carbon dispersed in polyimide (PI) and having a volume resistivity controlled to the order of 108 Ωcm is used. The intermediate transfer belt 7A has a thickness of 80 μm and an entire circumference of 900 mm.

Further, the intermediate transfer belt 7A in the second embodiment has the surface (outer peripheral surface) 7*a* subjected to mechanical abrasion. A toner image is transferred from the photosensitive drum onto the surface 7*a* of the intermediate transfer belt 7A, and the cleaning blade 60 of the belt cleaner is brought into contact with the surface 7*a*.

In the second embodiment, as the intermediate transfer belt 7A, an intermediate transfer belt subjected to mechanical abrasion so that the surface roughness Rz (ten-point average roughness) falls within a range of 0.2 μm or more and 5 μm or less is used. When the intermediate transfer belt 7A is combined with the cleaning blade 60 in the second embodiment, it is preferred that the surface roughness Rz of the intermediate transfer belt 7A be set to 0.2 μm or more and 3.0 μm or less.

When the surface roughness Rz is less than 0.2 μm, the contact width between the cleaning blade 60 and the surface 7*a* of the intermediate transfer belt 7Y becomes excessively large, and problems such as blade chattering, blade abrasion, and blade chipping occur, with the result that a satisfactory cleaning property may not be obtained. Meanwhile, when the surface roughness Rz is more than 5.0 μm, the cleaning blade 60 cannot sufficiently follow the surface shape of the intermediate transfer belt 7A, and the contact width is reduced excessively, with the result that untransferred residual toner cannot be blocked easily, and a cleaning defect such as passing of toner is liable to occur.

The surface roughness of the intermediate transfer belt 7A is measured as described below through use of a contact type surface roughness measuring instrument (product name: Surfcorder SE3500 manufactured by Kosaka Laboratory Ltd.). Under the conditions of a detector with a diamond needle of R2 μm and 0.7 mN, a filter of 2CR, a cut-off value of 0.8 mm, a measurement length of 2.5 mm, and a feed speed of 0.1 mm/sec, data on the ten-point average roughness Rz defined by JIS Standard B0601 is processed.

Mechanical abrasion may be performed with respect to an entire region of the surface of the intermediate transfer belt 7A or may be performed with respect to a part of the surface. In order to exhibit satisfactory performance, it is desired that mechanical abrasion be performed at least with respect to a surface portion that is brought into contact with the cleaning blade 60.

Further, also in the second embodiment, the verification experiment as described in Table 1 was performed. Further, in order to perform an accelerative verification experiment, the intermediate transfer belt 7A having a surface roughness Rz of 1.0 μm, which was manufactured by halving the time period of the cleaning step after the mechanical abrasion step as compared to the ordinary time period, was used. Also in this verification experiment, the same results as those in Table 1 were obtained.

Thus, also in the case of the second embodiment, both the passing of toner caused by abrasion particles and the reduction in wear life of the intermediate transfer belt can be suppressed.

Further, in the case of the second embodiment, even with the intermediate transfer belt in which the time period of the cleaning step after the mechanical abrasion step is halved, the passing of toner caused by abrasion particles can be suppressed. For example, as an indicator of the amount of abrasion particles remaining on the intermediate transfer belt, which is similar to that of the amount of abrasion particles remaining on the photosensitive drum, even when the height of abrasion particles becomes more than 4 μm, the passing of toner caused by abrasion particles can be suppressed through use of the configuration of the second embodiment. Further, even when the height of abrasion particles becomes 5 μm or more, 10 μm or more, and 13 μm or more, the passing of toner caused by abrasion particles can be suppressed through use of the configuration of the second embodiment. As a result, the cleaning step after the mechanical abrasion step of the intermediate transfer belt can be shortened, and the improvement in productivity of the intermediate transfer belt and the reduction in cost can be achieved.

[Other Embodiments]

The present invention can also be applied to a direct transfer type image forming apparatus configured to directly transfer an image from a photosensitive drum onto a recording material, in addition to the intermediate transfer type image forming apparatus having the intermediate transfer member as described above. Further, the photosensitive member may be a photosensitive belt instead of a photosensitive drum. Further, the intermediate transfer member may be an intermediate transfer drum instead of an intermediate transfer belt.

Further, the present invention can also be applied to image forming apparatus such as a copying machine, a facsimile machine, and a multifunctional peripheral, in addition to a printer.

According to the present invention, passing of toner can be suppressed with a configuration in which the surface of the image bearing member is subjected to mechanical abrasion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-252605, filed Dec. 27, 2017, which is hereby incorporated by reference herein in its entirety.

What is claimed is:

1. An image forming apparatus comprising:

an image bearing member configured to rotate while bearing a toner image; and a cleaning blade, which is to be brought into contact with a surface of the image bearing member, and is configured to clean the image bearing member, wherein the surface of the image bearing member which is brought into contact with the cleaning blade has a ten-point average roughness Rz of 0.2 μm or more and 5.0 μm or less, wherein the cleaning blade includes a rubber member, a distal end portion of the cleaning blade, which is to be brought into contact with the image bearing member, having a hardness higher than a hardness of a base portion, a contact force per unit length in a longitudinal direction of the cleaning blade with respect to the surface of the image bearing member being 0.196 N/cm or more and 0.490 N/cm or less, and wherein when the cleaning blade is brought into contact with an opposed object for measurement having a plurality of measurement recesses each having a partially spherical shape with a depth of 0.7 μm and a radius of 15 μm on a surface under the condition that a contact angle of the cleaning blade with respect to the opposed object for measurement is 25° and a free length of the cleaning blade is 8 mm, a contact width in a direction perpendicular to the longitudinal direction of the cleaning blade between the cleaning blade and the opposed object for measurement in each of the measurement recesses is 4 μm or more and 8 μm or less when the contact force per unit length in the longitudinal direction of the cleaning blade is 0.196 N/cm, and is 4 μm or more and 13.5 μm or less when the contact force per unit length in the longitudinal direction of the cleaning blade is 0.490 N/cm.

2. An image forming apparatus according to claim 1, wherein W/a obtained by dividing the contact force per unit length in the longitudinal direction of the cleaning blade by an imaginary inroad amount of the cleaning blade with respect to the image bearing member is 0.196 N/cm/mm or more and 0.441 N/cm/mm or less.

3. An image forming apparatus according to claim 1, wherein, when a surface of the cleaning blade extending in the longitudinal direction and a free length direction is defined as a first surface, and a surface of the cleaning blade extending in the longitudinal direction and a thickness direction is defined as a second surface, a position of 30 μm from a contact edge at which the cleaning blade is brought into contact with the surface of the image bearing member and a center of the free length are set to measurement points on the first surface, and a position of 30 μm from the contact edge and a center of a thickness are set to measurement points on the second surface, wherein a difference in indentation elastic modulus at the two measurement points on the first surface is 0.5 MPa or more and 10.0 MPa or less, or wherein a difference in indentation elastic modulus at the two measurement points on the second surface is 0.5 MPa or more and 10.0 MPa or less.

4. An image forming apparatus according to claim 1, wherein, when the image bearing member is subjected to a hardness test through use of a Vickers quadrangular pyramid diamond indenter under an environment having a temperature of 25° C. and a relative humidity of 50%, and the Vickers quadrangular pyramid diamond indenter is pressed into the image bearing member at a maximum load of 6 mN, a universal hardness is 150 $N/mm^2$ or more and 220 $N/mm^2$ or less, and an elastic deformation rate We is 40% or more and 65% or less.

5. An image forming apparatus according to claim 1, wherein the cleaning blade is made of a urethane rubber.

6. An image forming apparatus according to claim 1, wherein the surface of the image bearing member which is brought into contact with the cleaning blade is subjected to mechanical abrasion.

7. An image forming apparatus according to claim 1, wherein the image bearing member comprises a photosensitive member.

8. An image forming apparatus according to claim 1, wherein the image bearing member comprises an intermediate transfer member to which the toner image formed on a photosensitive member is transferred.

9. A method of manufacturing an image forming apparatus including an image bearing member configured to rotate while bearing a toner image, and a cleaning blade, which is brought into contact with a surface of the image bearing member, configured to clean the image bearing member, comprising:

a step of subjecting the surface of the image bearing member to mechanical abrasion;

a step of setting a hardness of a distal end portion of the cleaning blade, which is brought into contact with the image bearing member, to be higher than a hardness of a base portion of the cleaning blade in such a manner that when the cleaning blade is brought into contact with an opposed object for measurement having a plurality of measurement recesses each having a partially spherical shape with a depth of 0.7 μm and a radius of 15 μm on a surface under the condition that a contact angle of the cleaning blade with respect to the opposed object for measurement is 25° and a free length of the cleaning blade is 8 mm, a contact width in a direction perpendicular to the longitudinal direction of the cleaning blade between the cleaning blade and the opposed object for measurement in each of the measurement recesses is 4 μm or more and 8 μm or less when a contact force per unit length in a longitudinal direction of the cleaning blade is 0.196 N/cm and 4 μm or more and 13.5 μm or less when the contact force per unit length in the longitudinal direction of the cleaning blade is 0.490 N/cm; and a step of mounting the cleaning blade so that the contact force per unit length in the longitudinal direction of the cleaning blade with respect to the surface of the image bearing member is 0.196 N/cm or more and 0.490 N/cm or less.

10. A method of manufacturing an image forming apparatus according to claim 9, wherein the surface of the image bearing member has a ten-point average roughness Rz of 0.2 μm or more and 5.0 μm or less after the step of subjecting the surface of the image bearing member to mechanical abrasion.

* * * * *